US005842494A

United States Patent [19]

Wu

[11] Patent Number: 5,842,494

[45] Date of Patent: Dec. 1, 1998

[54] STRUCTURE OF UMBRELLA'S UPPER NOTCH AND FERRULE

[76] Inventor: Tsun-Zong Wu, 8F, No. 76, Lane 103, Sec. 2, Nei-Hu Rd., Taipei, Taiwan

[21] Appl. No.: 962,210

[22] Filed: Oct. 31, 1997

[51] Int. Cl.[6] ..... A45B 15/00

[52] U.S. Cl. ..... 135/33.41; 135/33.6; 24/108

[58] Field of Search ..... 135/33.6, 33.2, 135/33.4, 33.41, 3.7, 15.1; 403/105, 106, 329; 24/108, 548.1

[56] References Cited

U.S. PATENT DOCUMENTS

| | | | |
|---|---|---|---|
| 368,407 | 8/1887 | McCormick | 135/33.6 |
| 1,016,301 | 2/1912 | Sutlive | 135/33.4 X |
| 1,055,694 | 3/1913 | Anello | 135/33.41 X |
| 2,329,629 | 9/1943 | Levin | 135/33.41 X |
| 4,061,154 | 12/1977 | Cox et al. | 135/33.41 X |
| 4,422,467 | 12/1983 | Wu | 135/33.6 |
| 5,085,239 | 2/1992 | Chin-Hung et al. | 135/33.41 X |
| 5,758,678 | 6/1998 | Wu | 135/33.6 X |

*Primary Examiner*—Lanna Mai

[57] ABSTRACT

The present invention relates to the presentation of an improved structure of umbrella's upper notch and ferrule, comprising mainly an inner flange tube with an appropriate length at the top of an umbrella's upper notch, two opposite walls of said inner flange tube has the flexibility to shrink inward and expand outward, thus forming two resilient walls, the ferrule involves a cap body, in the cap body corresponding to the inner flange tube of the upper notch is a solid connector post, on the end of the connector post corresponding to the two opposite resilient walls of the inner flange tube is an expanded ratchet head portion; when the connector post of said ferrule has penetrated the fabric top and through the upper notch's inner flange tube and reached its position, the ratchet head portion at the end of said connector post will naturally be tightly secured to the ends of the inner flange tube's resilient walls, to prevent the ferrule from falling off, and to clamp the fabric top between the ferrule and the upper notch; since the upper notch is made of a somewhat soft material, the inner flange tube's resilient walls have excellent tenacity and flexibility, and the ferrule that is made of a hard material has a connector post that is solid made, so it will not easily be broken or damaged, therefore, it will improve on the weaknesses in a conventional umbrella's upper notch and ferrule, such as unstable joining, easily falling off, and easily broken or damaged ferrule connector post, etc.

2 Claims, 2 Drawing Sheets

STRUCTURE OF UMBRELLA'S UPPER NOTCH AND FERRULE

BACKGROUND OF THE INVENTION

The present invention relates to an improved structure of umbrella's upper notch, to enable secure bonding between the upper notch and the ferrule, and to prevent the ferrule from falling off.

Conventionally, at the lower end of an umbrella's upper notch is a channel tube to accommodate the center shaft, on the rim of the upper notch are a number of niches to accommodate the ends of the ribs, on the ribs is the fabric, then, on top of the upper notch is a ferrule to fasten the fabric top and meanwhile serve as a decorative item on the top.

Since the ferrule is located on the exterior of an umbrella, it is subjected to frequent contacts or friction with other objects, therefore, said ferrule is generally made of a wear-resistant hard material, compared to said ferrule, the upper notch is generally made of a somewhat softer material.

FIGS. 1 and 2 illustrate a conventional type of joining structure between the upper notch and the ferrule, said upper notch (1*a*) has its top opened in a connector hole (11), at the two opposite sides inside said connector hole are expanded shoulders (12); said ferrule (2*a*) has a cap body (21), said cap body corresponding to the connector hole of the upper notch (1*a*) is a connector post (22), the two opposite sides of said connector post have an expanded cone post head (23), in the middle of said connector post is an opening (24), so that said connector post has a flexibility to shrink inward and expand outward. When the connector post (22) of the ferrule (2*a*) penetrates the fabric (3) top and through the connector hole (11) of the upper notch (1*a*) and reaches its position, the cone post head (23) at the end of said connector post will naturally open outward to be secured to the shoulders (12) of the connector hole (11 ) of the upper notch (1*a*), thus achieving the fastening effect.

However, the ferrule (2*a*) is generally made of a hard material, its connector post (22) has a poor flexibility and is easily broken or damaged, resulting in its unstable connection with the shoulders (12) of the connector hole (11) of the upper notch (1*a*), therefore, in the assembling process in actual application, said ferrule (2*a*) will be falling off, and the result is failure to secure the top side of fabric (3) or incomplete umbrella top.

FIG. 3 illustrates another type of joining structure between a conventional upper notch and its ferrule, which are fastened with screws, that is, on the top of upper notch (1*b*) is a screw hole (13), its ferrule (2*b*) has a cap body (21), on said cap body corresponding to the position of the upper notch screw hole is a screw bolt (25), by tightening the screw bolt (25) with the screw hole (13), the ferrule (2*b*) can be screwed onto the upper notch (1*b*), and secure the fabric top to between said ferrule and upper notch. However, the ferrule in such a structure of ferrule and upper notch is easily loosened and falling off.

SUMMARY OF THE INVENTION

In view of the weaknesses in the conventional application of the upper notch and its ferrule, the subject inventor has designed and presented a type of improved construction of umbrella's upper notch and its ferrule, to enable secure bonding of the two, to prevent the ferrule from falling off, to fasten the fabric top, and maintain an integral appearance of the umbrella top.

The present invention is characterized in that, the top of the upper notch is opened to have an inner flange tube with an appropriate length, said inner flange tube has two opposite walls that form a recess as a clearance apart from the solid block portion of the upper notch, so that the two opposite walls of the inner flange tube has a flexibility to shrink inward and expand outward, forming resilient walls, the ferrule of the umbrella has a cap body, on said cap body corresponding to the inner flange tube of the upper notch is a solid-made connector post, at the end of said connector post corresponding to the two opposite resilient walls of the inner flange tube is a ratchet head portion; in the process when the connector post of said ferrule penetrates the fabric top and through the inner flange tube of the upper notch to reach its position, the ratchet head portion at the end of said connector post will naturally be secured tightly to the ends of the inner flange tube resilient walls, to prevent the ferrule from falling off, and to secure the fabric top to between the ferrule and the upper notch; since the upper notch is made of a soft material, the resilient walls in the inner flange tube have excellent tenacity and flexibility, and the ferrule made of a hard material with its connector post that is solid made will not easily be broken or damaged, therefore, it has improved on the weaknesses in the connection of conventional upper notch and its ferrule, such as unstable joining, easily falling off, and easily broken or damaged connector post of ferrule, etc.

DETAILED DESCRIPTION OF PREFERRED EMBODIMENT

Figure 1:
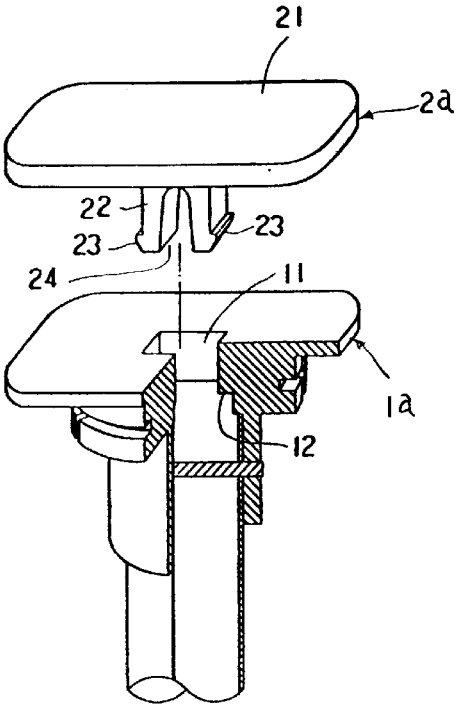
FIG. 1 (Prior Art)
FIG. 1 is a perspective disassembled view with a partially sectional view of an embodiment of a prior art of an umbrella's upper notch and ferrule.
Figure 2:
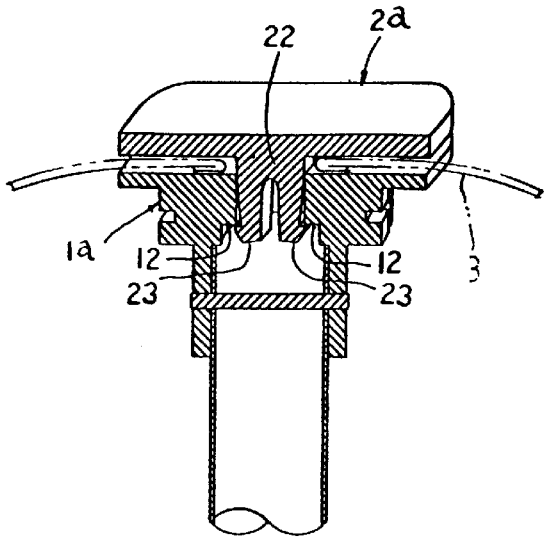
FIG. 2 (Prior Art)
FIG. 2 is a sectional assembled view of FIG. 1.
Figure 3:
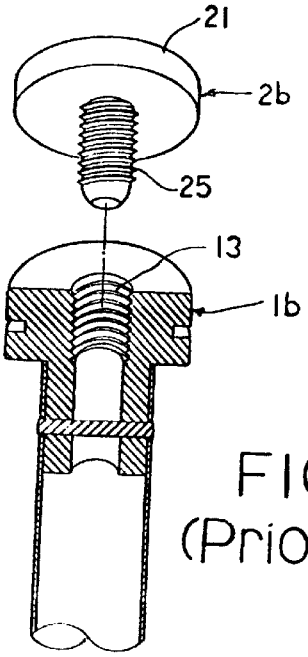
FIG. 3 (Prior Art)
FIG. 3 is a perspective disassembled view with a partially sectional view of another embodiment of a prior art of an umbrella's upper notch and ferrule.
Figure 5:
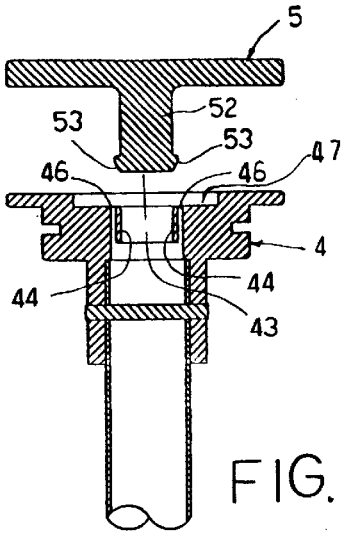
FIG. 5 is a sectional disassembled view of FIG. 4.
Figure 6:
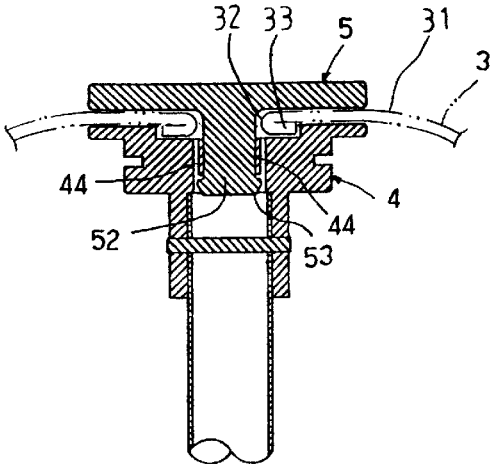
FIG. 6 is a sectional assembled view of FIG. 4.
Figure 4:
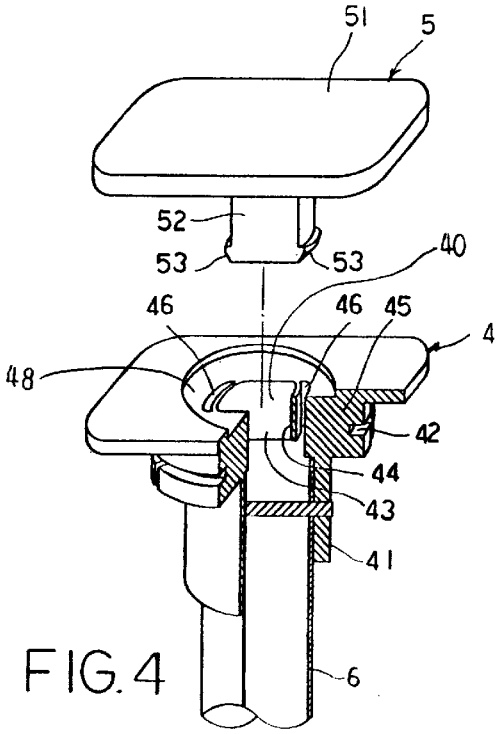
FIG. 4 is a perspective disassembled view with a partially sectional view of the present invention of umbrella's upper notch and ferrule.

The preferred embodiment of the present invention can be understood from the following description with accompanying drawings.

As illustrated in the drawings, the present invention comprises an upper notch (4) and a ferrule (5).

Said upper notch (4) is made of a somewhat soft plastic material, on its lower end is a channel tube (41) that serves to accommodate a center shaft (6), on the rim of the upper notch are a number of niches (42) that serve to accommodate the ends of ribs (not shown in drawing), on the ribs is an umbrella fabric, such a construction is the same as a conventional upper notch. The present invention of upper notch (4) is characterized in that, at its top is an inner flange tube (43), in the inner flange tube between two opposite walls (44) and the upper notch body (45) is the formation of a recess (46) deeply recessed in the upper notch (4), so that the two opposite walls in the inner flange tube has a flexibility to shrink inward and expand outward, hence said opposite walls have become resilient walls (44), therefore, said resilient walls is positioned between the control hole (40) and the recess (46), and said recess (46) is defined between the resilient walls (44) and the solid block portion (48) of the upper notch (4).

Said ferrule (5) is made of a somewhat hard plastic or metal material, comprising a cap body (51), said cap body corresponding to the inner flange tube has a solid connector post (52), the end of said solid connector post corresponding to the two opposite resilient walls (44) in the inner flange tube is the formation of an expanded ratchet head portion (53).

The ferrule (5) is fastened in position with its connector post (52) penetrating the center hole (32) on the top (31 ) of the fabric (3), through the upper notch (4) and the inner flange tube (43), in the process when the ratchet head portion (53) at the end of the connector post (52) penetrates the inner flange tube (43) of the upper notch (4), at first, said ratchet head portion (53) will extend the two opposite resilient walls (44) in the inner flange tube (43), when the ratchet head portion has penetrated in position, that is, when said ratchet head portion has penetrated the inner flange tube, the two opposite resilient walls (44) in said inner flange tube will naturally clamp inward, to immediately become tightly engaged with said ratchet head portion (53), to prevent the ferrule (5) from running off, and to fix the top of the fabric (3) between the ferrule (5) and the upper notch (4).

Since the upper notch is made of a somewhat soft material, its inner flange tube resilient walls (44) have excellent flexibility, while a conventional ferrule made of a hard material has its connector post that is solid made which will not be easily broken or damaged, therefore, it has improved on the weaknesses in a conventional upper notch and ferrule, such as unstable joint, easily running off, and easily damaged connector post of its ferrule, etc.

Besides, on the top side of the upper notch (4) is a depression (47) to accommodate the folding (33) on the rim of the top center hole (32) of the fabric (3), to prevent the thickness of said folding from obstructing the tight adhesion between the upper notch (4) and the ferrule (5), therefore, said depression will enable the upper notch and the ferrule to tightly clamp the top of the fabric (31).

I claim:

1. An improved umbrella's upper notch and ferrule comprising:

an upper notch having a rim, a lower end, a top, and a solid block portion; a channel tube on the lower end to secure to an umbrella center shaft, a plurality of niches on the rim to secure the ends of a plurality of ribs; said ribs support a fabric cover; the top of said upper notch being opened to include an inner flange tube that extends downwardly to a predetermined length;

said inner flange tube having two opposite flexible walls; a recess being formed between said opposite walls and said solid block portion of said upper notch to allow said opposite walls of said inner flange tube to shrink inwardly and expand outwardly;

a ferrule having a cap body; a solid connector post on said cap body fits in said inner flange tube of the upper notch; an expanded ratchet head portion formed on an end of said solid connector post to securely engage the ends of said opposite flexible walls of said inner flange tube to prevent the ferrule from falling off and to fasten the top of said fabric cover between said ferrule and said upper notch.

2. The improved umbrella's upper notch and its ferrule, as recited in claim 1, wherein, on top of the upper notch is a depression to accommodate the folding on the rim of the center hole on the top of the fabric, so that the upper notch and the ferrule will be able to tightly clamp the fabric top.

* * * * *